United States Patent [19]

Sausele

[11] 4,317,287

[45] Mar. 2, 1982

[54] MICROIDENTIFICATION SYSTEM

[76] Inventor: George J. H. Sausele, 15 Apple Hill, Lynnfield, Mass. 01940

[21] Appl. No.: 73,701

[22] Filed: Sep. 10, 1979

[51] Int. Cl.[3] ..... B43L 13/10

[52] U.S. Cl. ..... 33/24 R

[58] Field of Search ..... 33/24 R, 24 B, 24 C, 33/23, 25; 283/7; 32/1; 409/85, 86, 219, 93, 225; 269/321 W, 321 A, 289

[56] References Cited

U.S. PATENT DOCUMENTS

| | | | |
|---|---|---|---|
| 332,990 | 12/1885 | Benton | 33/24 R |
| 366,987 | 7/1887 | Westlake | 33/24 B |
| 1,180,906 | 4/1916 | Clark | 33/24 B |
| 1,421,426 | 7/1922 | Eaton | 33/24 B |
| 1,484,660 | 2/1924 | McEwen | 33/24 B |
| 2,139,150 | 12/1938 | Curtis et al. | 206/0.83 |
| 2,327,811 | 8/1943 | McRae | 33/23 X |
| 2,346,719 | 4/1944 | Aske | 269/8 X |
| 2,434,553 | 1/1948 | Ensley | 206/0.83 |
| 3,108,379 | 10/1963 | Aaron | 33/19 A |
| 3,283,713 | 11/1966 | Wooster | 283/7 X |
| 3,333,341 | 8/1967 | Wuerthner | 33/25 R |
| 3,771,870 | 11/1973 | Taylor | 33/184.5 X |
| 4,027,391 | 6/1977 | Samis | 32/1 |

FOREIGN PATENT DOCUMENTS

| | | | |
|---|---|---|---|
| 509442 | 3/1952 | Belgium | 33/24 B |

OTHER PUBLICATIONS

"Identification of Mass Disaster Victims: The Swiss Identification System", Muhlemann et al., Journal of Forensic Sciences, 2/22/78.

*Primary Examiner*—Harry N. Haroian

*Attorney, Agent, or Firm*—Cesari and McKenna

[57] ABSTRACT

An inexpensive manual microidentification system includes a carrier card having the workpiece to be engraved mounted thereon and providing a surface for recording the information engraved on the workpiece; and a simple, inexpensive microengraver formed from a scriber mounted on a ball and socket arrangement, and including a stylus for tracing a pattern to be engraved on a workpiece as well as an elongated spindle interconnecting the two and providing a large mechanical advantage to the motion of the stylus relative to that of the scriber. The carrier card is cantilever mounted adjacent to the scriber; this mounting technique, together with the resilient composition of the card, insures a controlled scribing pressure. The workpiece is held out of contact with the scriber by means of a finger pressing against the card and biased by a spring. A slide bar connected to the finger is actuated by the operator to oppose the spring force when engraving is to take place to thereby allow the workpiece to contact the scriber for engraving. Accurate registration of the workpiece and the scriber is insured by apertures formed in the carrier card which is positively located within the mounting. After engraving, the work piece is separated from the carrier card for use, and the card is filed for reference as a permanent record.

8 Claims, 8 Drawing Figures

MICROIDENTIFICATION SYSTEM

BACKGROUND OF THE INVENTION

A. Field of the invention

The invention relates to micro-miniature identification systems and comprises a method and apparatus for quickly and inexpensively inscribing identifying information on an extremely small workpiece while providing a separate corresponding record of the inscribed information.

B. Prior Art

A micro-miniature personal identification system is described in U.S. Pat. No. 4,027,391, issued June 7, 1977 to Philip Samis. The identification element shown there comprises a small metallic chip on the order of 1.5 millimeters square and one half millimeter in thickness. The chip is designed for insertion in the filling of a tooth and carries personal identifying information such as the recipient's name, and other identifying information permanently inscribed thereon. The characters of the inscription are correspondingly small, of the order of 0.001 to 0.010 inches high.

The size of the chip imposes severe contraints on the handling and inscription of the chip, and conventional engraving techniques, whether chemical, mechanical, or other (e.g. laser) are ill-suited to this operation. To begin with, the very size of the chip imposes stringent requirements on registration of the chip with the implement or agent which is to effectuate the inscription. Further, many of these techniques are economically feasible only when used in a batch-processing operation where large numbers of these chips can be processed at once as is commonly done, for example, in the production of electronic integrated circuits. This effectively precludes the use of such systems in circumstances where only intermittent use may be called for, e.g. in individual dentists' offices. Further, even where the requisite volume for batch processing is present, or the delays imposed by batch processing are acceptable, the difficulties in accurately segregating and further handling the individual chips is substantial, and considerable precautions are required to avoid error.

SUMMARY

A. Objects of the Invention

Accordingly, it is an object of the invention to provide a microidentification system that is relatively inexpensive to make and that is simple and economical to use even when inscribing chips one at a time.

Further, it is an object of the invention to provide a microidentification system in which the chips on which the information is recorded are readily sorted and continuously associated with card file information records.

Another object of the invention is to provide a simple, inexpensive, convenient means of handling the chips on which information is to be recorded.

Still, another object of the invention is to provide a relatively inexpensive but precise microidentification system that is simple to use.

Further, it is an object of the invention to provide a microidentification system that simply but accurately positions a workpiece to be engraved in the vicinity of the scriber that is to engrave it.

Yet another object of the invention is to provide a recording medium for the information on the chip that remains physically associated with the chip during inscription.

B. Brief Description of the Invention

In accordance with the present invention, I provide a simple, inexpensive microidentification system comprising a work piece, a carrier for accurately mounting the work piece and registering it for engraving, and a simple, inexpensive microengraver that is readily operable by relatively untrained personnel and which can conveniently be located in an individual dentist's office. The work piece is of the type shown and described in U.S. Pat. No. 4,027,391, referred to above. It is detachably mounted on a thin, flat, resilient carrier in the form of a rectangular card, preferably of a plastic material or the like. In addition to serving as a carrier for the workpiece, the card provides a surface for recording a readable copy of the information that is to be inscribed on the workpiece. Registration apertures are provided in the card to accurately align the card with the engraving instrument. The latter comprises a simple, relatively inexpensive, compact microidentification system having a head portion which contains the scriber and accomodates the workpiece to be engraved; a base portion which supports a pattern to be engraved on the workpiece; and an elongated spindle interconnecting the scriber and the stylus to enable the scriber to form a reduced image of the pattern traced by the stylus.

The card is cantilever-mounted in the microengraver head and is located to position the workpiece in contact with the stylus during engraving. The card is normally held out of contact with the scriber by means of a finger which pushes against the free (non-supported) end of the card and deforms it slightly to lift the workpiece from the scriber. The finger is biased by a spring. A link connected to the finger is actuable by the operator to remove the finger from contact with the card to thereby free the card to return to its undeformed position in which it presses the workpiece against the scriber. The force with which this is accomplished is a function simply of the "spring" characteristics of the card as defined by its composition, its geometry, and its mounting, and these are easily and relatively inexpensively controlled to thereby provide a controlled scriber force. This insures a uniform, repeatable inscription that is accomplished in a simple machine and at relatively low cost.

The carrier card contains registration apertures which mate with corresponding bosses on the cantilever mount in the microengraver so as to insure accurate location of the workpiece with respect to the scriber. The mount is formed from a base in the form of a block in which one end of the card is placed. Bosses protruding from the block engage apertures in the carrier card to provide precise registration of the card, and thus the workpiece, with respect to the scriber. The card is further secured to the base by means of a clamp, corresponding to the base, which is placed over the card and which has apertures which mate with the bosses on the base. The clamp is conveniently carried on a hinged cover on the microidentification system head so that it is swung into position over the carrier base when the cover is closed. A latch secures the cover, and thus the clamp, when the cover is closed.

The scriber is mounted on a universal bearing in the form of ball and socket arrangement. The scriber is affixed to one side of the ball, and the spindle is fixed to the other side to allow movement of the ball, and thus the scriber, by the operator.

The stylus is mounted on the end of the spindle by inserting one end of the stylus into a hollowed central core of the spindle in which a bias spring is located and which urges the stylus outwardly of the spindle. This facilitates tracing of the pattern by the stylus while accommodating irregularities in the pattern and enabling the operator to remove the stylus from the pattern for spacing or other purposes and thereafter quickly return it to the pattern for tracing. Advantageously, the pattern is in the form of an embossed strip or series of strips containing the information to be engraved on the workpiece.

The slide bar which controls contact between the workpiece and the scriber preferably terminates in a crossbar located in the vicinity of the stylus. This allows the operator to position his or her hands in the same general position that one utilizes for writing, one hand then controlling contact between the workpiece and the stylus, while simultaneously steadying the operator, and the other hand controlling the stylus during inscription. This provides a convenient, natural position for the operator, and facilitates use of the instrument.

The instrument of the present invention is particularly suited for use in inscribing identification plates of the kind described in U.S. Pat. No. 4,027,391 described above.

BRIEF DESCRIPTION OF THE DRAWINGS

The foregoing and other and further objects and features of the invention will be more readily understood from the following detailed description of the invention, when taken in conjunction with the accompanying drawings, in which.

DETAILED DESCRIPTION OF THE INVENTION

Figure 1:
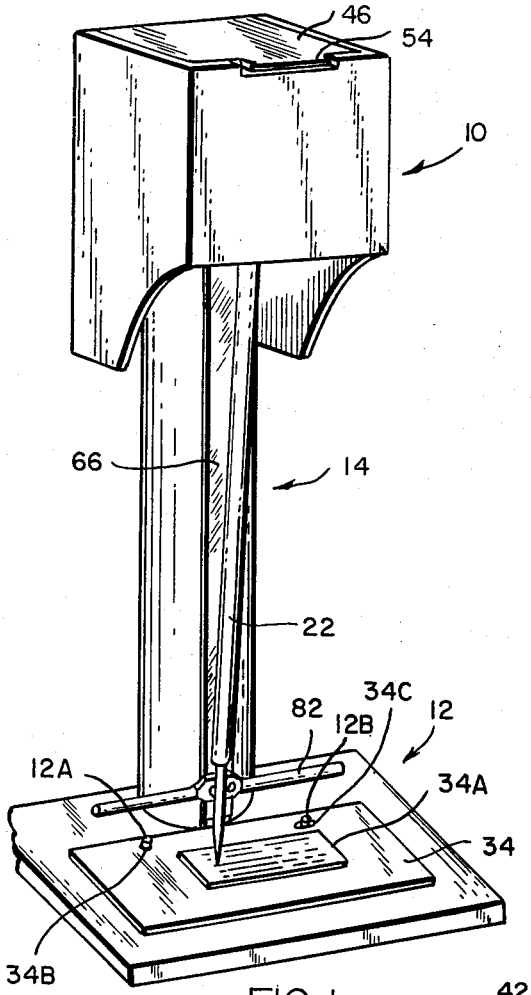
FIG. 1 is a front view in perspective of a preferred embodiment of microidentification system constructed in accordance with the present invention.
Figure 2:
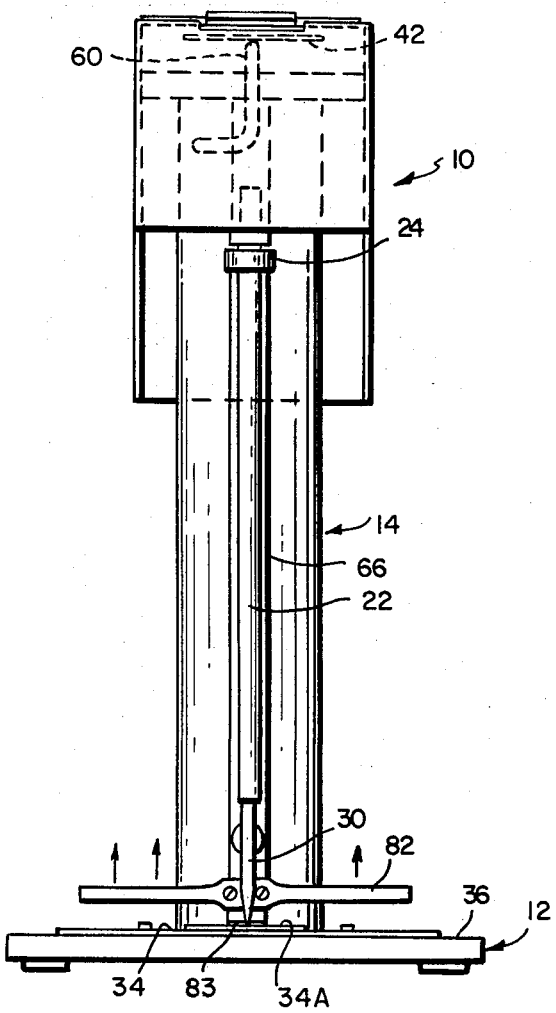
FIG. 2 is a front elevational view of the microidentification system of FIG. 1 with portions show in phantom.
Figure 3:
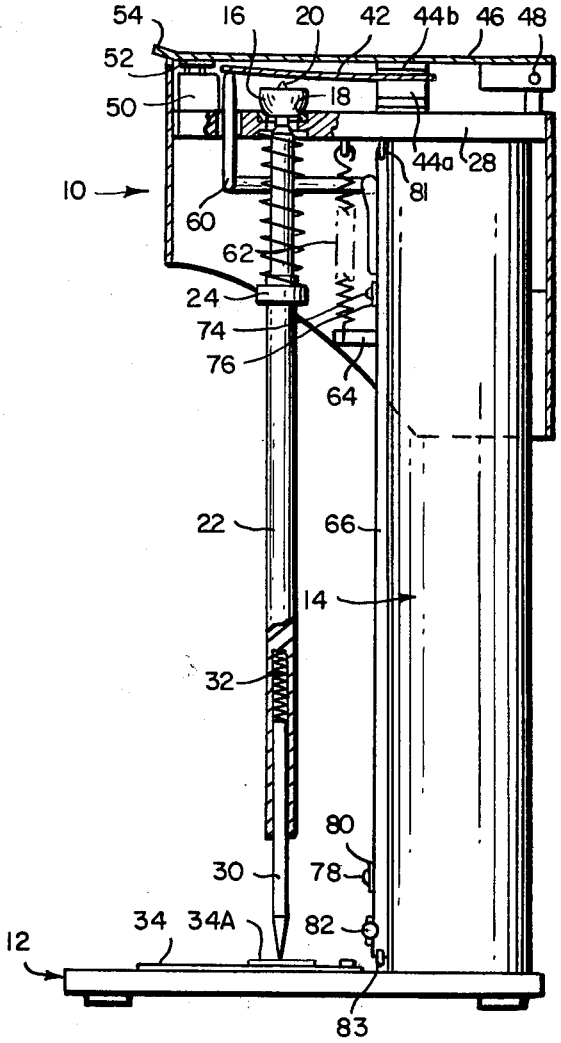
FIG. 3 is a left side elevational view of the microidentification system of FIG. 1 with portions of the housing broken away for clarity.

Referring now specifically to FIGS. 1 through 3, the microidentification system of the present invention includes a microengraver having an upper or "head" portion 10, a lower of "base" portion 12, and an intermediate frame 14 supporting the head above the base. Contained within the head 10 are a ball 16 mounted for rotation in a socket 18 and carrying a scriber 20 on an upper truncated surface thereof. The ball 16 is connected on its lower end to a spindle 22. A collar 24 on the spindle seats a spring 26 (see FIGS. 7 and 8) which bears against the platform 28 in which the socket 18 is mounted. The spring 26 secures the ball 16 in the socket 18 and allows the ball to rotate within the socket when the spindle is moved by an operator.

The spindle 22 terminates in a stylus 30 mounted within an elongated hollow core in the lower end of the spindle and is biased outwardly of the core by a spring 32. The stylus bears against a pattern on card 34 mounted on a lower platform 36 forming the base of the instrument.

The pattern comprises a card 34 on which an enlarged reverse image 34A of the microengraving is applied. The height of the letters advantageously is on the order of 3/16" which, with a 45:1 reduction ratio, provides for microengraved letters on the order of 0.004" high.

The pattern image is applied in accurate alignment with the register holes 34B and 34C which, in turn, provide for alignment of the pattern on base 12 by engraving pins 12A and 12B on said base.

The pattern image 34A may be in the form of hand drawn block letters written over a printed form on card 34. Preferably, however, the pattern 34A is in the form of embossed strips with an intaglio image in which stylus 30 is more readily guided for convenient tracing.

The embossed strips are advantageously prepared by a simple inexpensive and readily used system such as the Dymo labeling system ("Dymo" is a registered trademark of Dymo Visual Systems Inc. for its plastic tape embossing system). The tape is embossed so as to form a negative intaglio image on the smooth side. The other side of the tape carries a pressure sensitive adhesive by which the tape strips are applied to card 34 to form pattern 34A.

Figure 4:
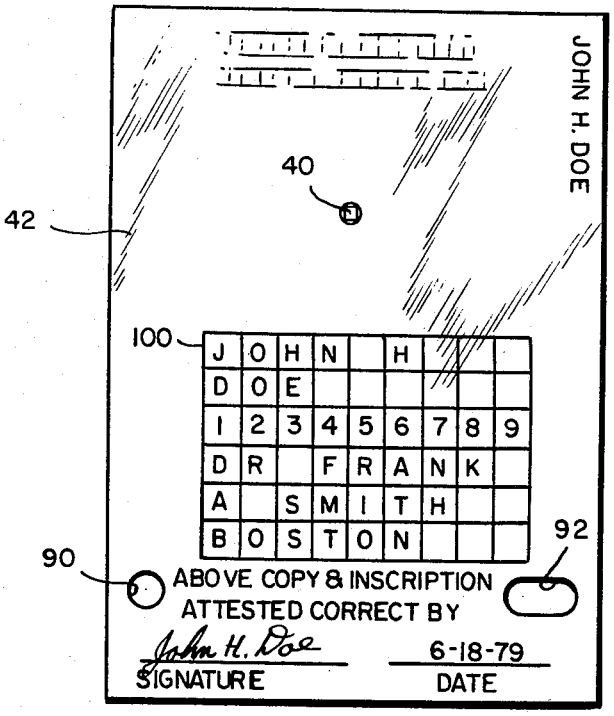
FIG. 4 is a top plan view of a preferred form of card in accordance with the present invention.
Figure 6:
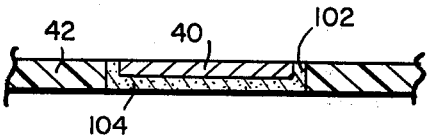
FIG. 6 is a partial cross-sectional view along the lines 6—6 of FIG. 5.
Figure 5:
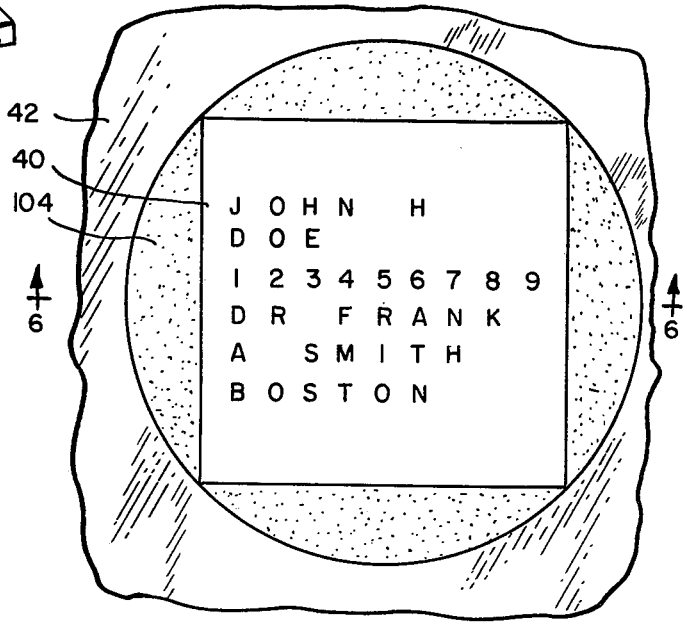
FIG. 5 is an enlarged view of a portion of the carrier card of FIG. 4.

The scriber 20 is positioned opposite a workpiece 40 on a carrier card 42 (FIGS. 4 through 6). This card is in the form of a thin flat plate, rectangular in shape, and of a resilient material to provide controlled deformation under force, with a return to its original state when the force is removed. Advantageously, it is made of a plastic material, but may also be made of the same material as the workpiece, e.g. stainless steel.

The card 42 is mounted in a clamp 44 (shown in more detail in FIG. 8) formed from a lower clamp portion **44*a* which is mounted on platform 28, and an upper clamp portion 44*b* which is mounted on a cover 46 of the microidentification system. Cover 46 is hinged so as to pivot about pivot 48. A magnetic latch 50 mounted on platform 28 co-acts with a corresponding latch bar 52 on cover 46 to secure the cover closed. A lip 54 enables the operator to grasp the cover to release it from the latch 50 and rotate it upwardly and backwardly about pivot 48**.

In the positions shown in FIGS. 2 and 3, the workpiece 40 is held out of contact with the scriber 20 by means of a finger 60 which presses against the unsupported ("free") end of the card 42, thereby slightly deforming it and holding it away from the scriber 20. The finger 60 is held in this "inactive" position by means of a spring 62 which has one end thereof connected to the platform 28 and the other end thereof to a post 64 carried by a slide bar 66 to which the finger 60 is attached by means of screws 68, 70 (see FIGS. 7 and 8). Slide bar 66 has an upper slide aperture 72 (FIGS. 7 and 8) through which a screw 74 and collar 76 extend and a corresponding lower aperture (not shown) through which a corresponding screw 78 and collar 80 extend. The screws 74 and 78 screw into the post 14 and, with the collars and slide apertures, provide for vertical sliding movement of the slide bar 66 along the post 14, thus moving the finger 60 into contact with the card 42 when the slide bar 66 is moved to its upper position, and moving the finger 60 out of contact with the card 42 when the slide bar 66 is moved to its lower position. Rubber stops 81 and 83 limit vertical movement of the slide bar.

A crossbar 82 is secured to the slide bar 66 at a lower portion thereof adjacent the stylus 30. The crossbar facilitates the operator's control of the position of the slide bar 66. Thus, absent any force by the operator on the crossbar 80, the slide bar 66 is held in its uppermost position by spring 62, and thus the finger 60 holds the card 42 away from the scriber 20. When the bar 82 is depressed by the operator, slide bar 66, and thus finger 60 is moved downwardly out of contact with the card 42 and the card then presses the workpiece 40 securely against the scriber and with a predetermined force, to facilitate inscription thereon.

Figure 7:
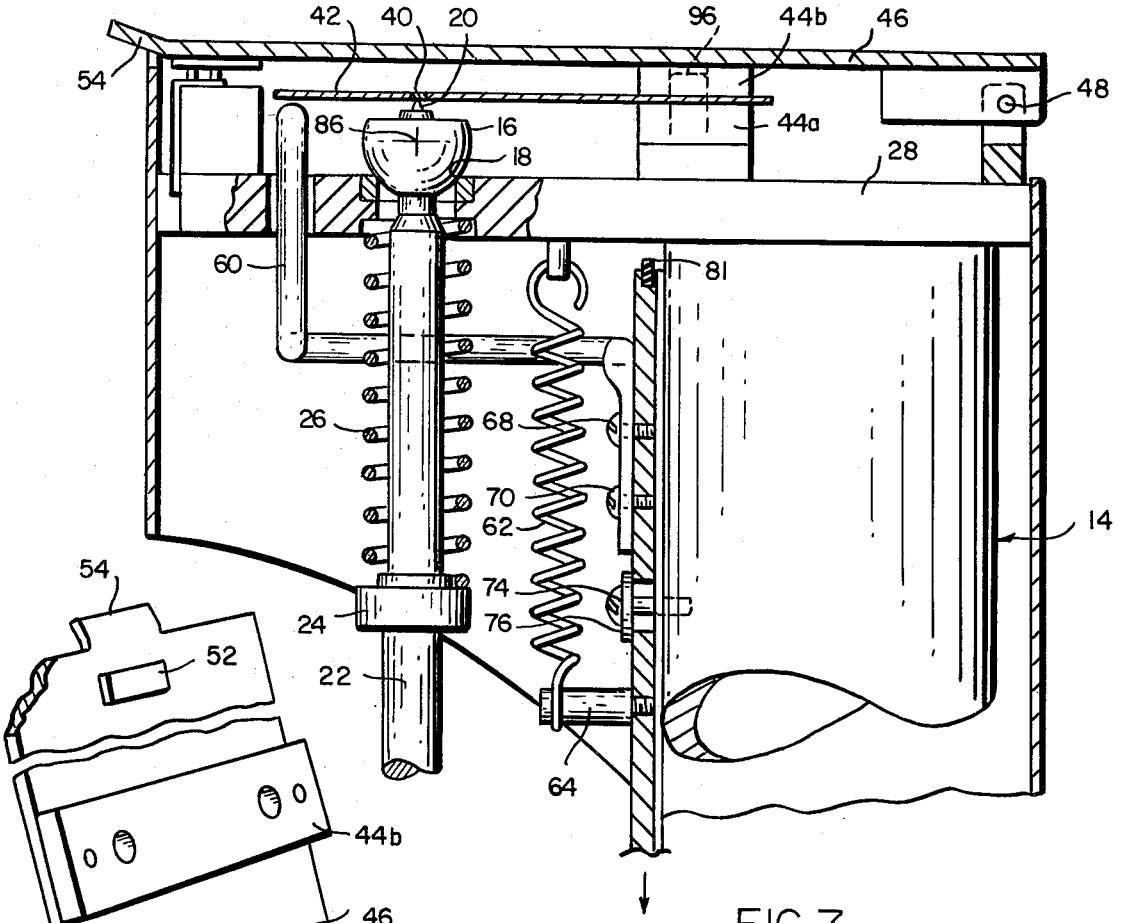
FIG. 7 is an enlarged view, in section, of the upper or "head" portion of the microidentification system of FIG. 1.
Figure 8:
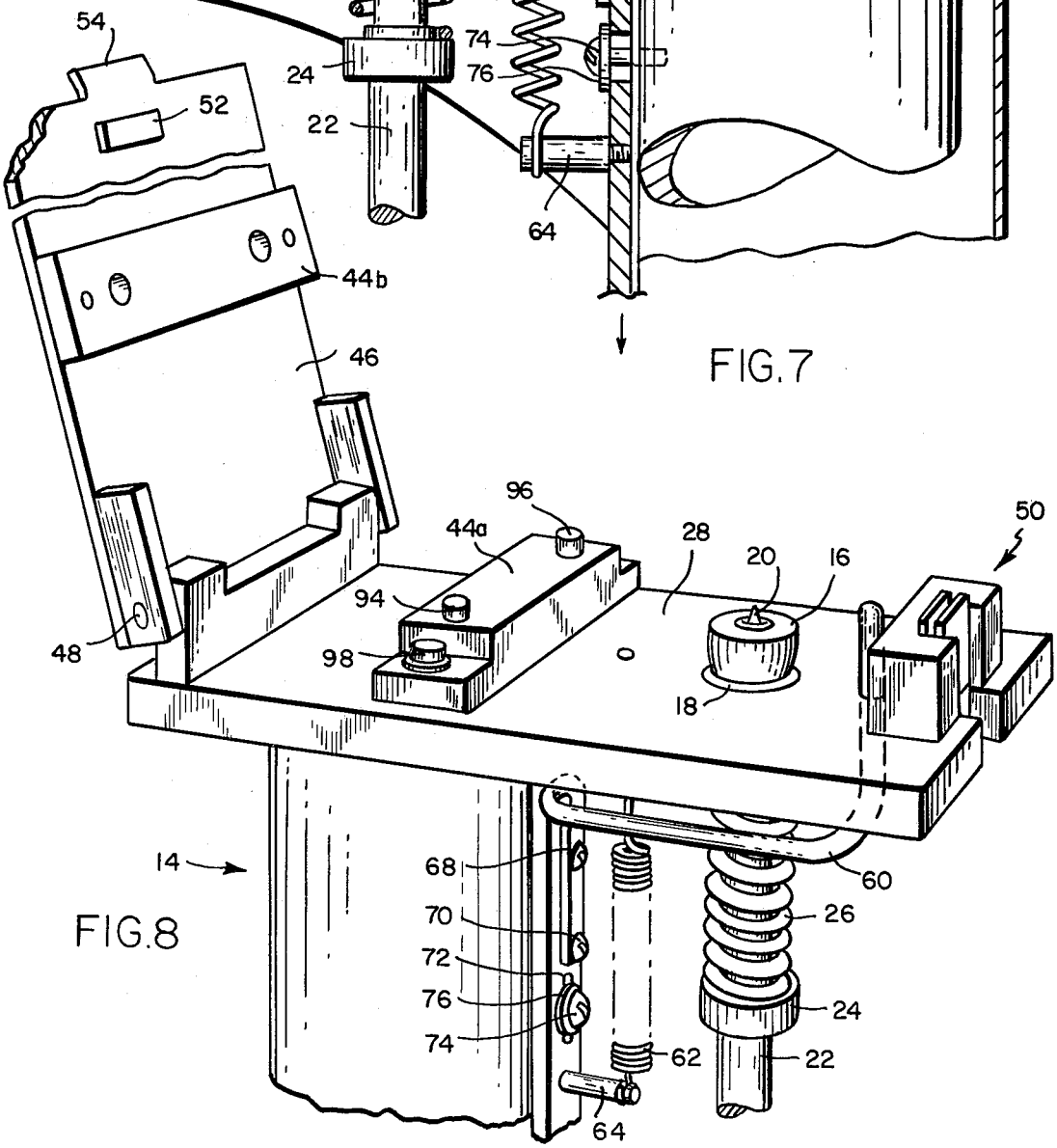
FIG. 8 is a left front view in perspective, of the upper portion of the microidentification system of FIG. 1. with portions of the housing removed for clarity.

The effective center of rotation of the ball 16 is designated by the numeral 86 in FIG. 7. The distance from the center of rotation to the point of contact of the stylus 30 with the pattern 34, when divided by the distance between the center of rotation and the tip of the scriber 20, is the reduction ratio or "mechanical advantage" of the microidentification system shown here. In the preferred embodiment shown here, these distances are 18 inches and 0.400 inches, respectively, thus resulting in a reduction ratio of 45 to 1.

Referring now specifically to FIGS. 4 through 6, the card 42 is shown in detail. It comprises a thin, flat generally rectangular plate of resilient material, having the workpiece 40 mounted thereon and having apertures 90, 92 extending therethrough. These apertures receive the bosses 94, 96 respectively, (FIG. 8) when the card 42 is mounted on the base 44*a*. During manufacture and assembly of the microidentification system of the present invention, the carrier base 44*a* is located precisely with respect to the scriber 20 and fixed in this location by means of two securing screws, one of which is shown at 98, (FIG. 8) which extend through the carrier base 44*a* and into threaded holes in upper platform 28. Further, during manufacture of the cards 42, the workpiece 40 is located at a precise position on the card. Thus, the operator need only insert the card 42 onto the carrier base 44*a* by positioning the apertures 90, 92 over the bosses 94, 96, respectively, and pressing downwardly on the card to seat it. Once this is accomplished, the workpiece 40 is precisely aligned over the scriber 20.

The card 42 also carries a recording section 100 in which the information that is to be inscribed on the workpiece 40 is recorded. Thus, once the workpiece is removed from the card 42, the card serves as a permanent record of what was inscribed on the workpiece and this record may be catalogued or otherwise filed as an index card for future reference as necessary. Typically the card contains the name and other pertinent identifying indicia of the person receiving the chip.

FIGS. 5 and 6 show the workpiece 40 in greater detail. As shown, the workpiece comprises a rectangular plate of small dimensions (e.g., 0.050 inch square) held within an aperture 102 by cement 104. Alternatively, the workpiece may be integral with the substrate and punched out from the substrate after engraving. In this case stainless steel would be a suitable material for the card. In either event, after the engraving is completed and attested correct, e.g. inspection under a microscope, the workpiece is removed from the card for use and the card retained as a reference record.

CONCLUSION

From the foregoing, it will be seen that I have provided a simple, economical, microidentification system. The system includes a carrier card, a workpiece to be engraved mounted on the card, and a simple, economical, easily usable microengraver. The microengraver is convenient to use and readily portable; it is simple in design and construction and, thus, reliable in operation.

It will be clear from the foregoing that various changes may be made in the invention herein without departing from either the spirit or the scope of the invention. Thus, for example, operation of the slide bar 66 could be mechanized through use of a switch-operated electrical solenoid which depresses the slide bar whenever the operator closes the switch. Similarly, movement of the stylus, which is wholly performed by the operator in the preferred embodiment shown herein, could be mechanized to automatically follow patterns placed on the platform 36. Scriber motion could also be controlled by an electronic X-Y table as is commonly used in the numerical controlled machine tool art. Various other changes may be made in the preferred shown herein without departing from either the spirit or the scope of the invention and it is intended that the foregoing be taken as illustrative only, and not in a limiting sense, the scope of the invention being defined with particularity in the claims.

Having illustrated and described my invention, I claim:

1. A microidentification system comprising

A. a resilient carrier-card for supporting a workpiece to be engraved a workpiece mounted on said carrier-card, B. a scriber selectively actuable into contact with said workpiece to engrave information thereon, C. means mounting said carrier-card for engaging said workpiece in scribing contact with said scriber, D. means forming a finger biased to engage said card and resiliently deform it to disengage said workpiece from said scriber when said workpiece is not to be inscribed, and E. means for disengaging said finger from said carrier-card when said workpiece is to be inscribed.

2. A microidentification system according to claim 1 which includes means for supporting a stencil, containing information to be engraved, in a position for tracing by a stylus connected to said scriber.

3. A microidentification system according to claim 1 which includes an elongated slide bar (1) carrying said finger on one end thereof and a grip on the other end thereof, and (2) mounted to position said grip adjacent said stylus for actuation by said operator when said workpiece is to be engraved.

4. A microidentification systems according to claim 1 in which said means for mounting said carrier card comprises means for securing one end of said carrier-card in cantilever fashion.

5. A microidentification system according to claim 1 in which said carrier-card mounting means comprises:

(1) a base plate, (2) a clamp mateable with said baseplate to secure said workpiece therebetween and, (3) means mounting said base plate and said clamp for motion relative to each other.

6. A microidentification system according to claim 5 in which said base plate carries a plurality of bosses for engagement with a corresponding plurality of apertures on said base plate to thereby orient said base in said clamp.

7. For use in a microengraver, having a scriber selectively actuable to scribe a workpiece, means for positioning said workpiece for scribing, and means for disengaging said workpiece from said scriber, the improvement comprising a resilient carrier card having a scribable workpiece mounted thereon, said carrier-card being mountable in said positioning means to engage said workpiece with said scriber and resiliently deformable in response to force applied thereto by said disengaging means to disengage said workpiece from said scriber.

8. A carrier-card according to claim 7 which comprises a thin plate for mounting in cantilever fashion to provide a defined force against said scribe during scribing.

* * * * *